US005908979A

United States Patent [19]

Miyamae

[11] Patent Number: 5,908,979

[45] Date of Patent: Jun. 1, 1999

[54] GOLF BALL TEST HITTER

[76] Inventor: Toshiaki Miyamae, I-9-15, Nakagawanishi, Ikuno-ku, Osaka, Japan

[21] Appl. No.: 08/985,860

[22] Filed: Dec. 5, 1997

[51] Int. Cl.[6] ..... G01M 7/00

[52] U.S. Cl. ..... 73/12.14; 73/12.02; 473/151

[58] Field of Search ..... 73/12.01, 12.02, 73/12.09, 12.14; 473/151, 226, 282

[56] References Cited

U.S. PATENT DOCUMENTS

| | | | |
|---|---|---|---|
| 1,703,507 | 2/1929 | Barnhart . | |
| 1,995,170 | 3/1935 | Davis | 73/12.02 |
| 2,058,201 | 10/1936 | Young | 73/12.02 |
| 3,373,612 | 3/1968 | Thompson et al. . | |
| 3,444,729 | 5/1969 | Shobert . | |
| 3,855,842 | 12/1974 | Imabori et al. | 73/12.02 X |
| 4,062,222 | 12/1977 | Solheim | 73/12.02 |
| 4,996,867 | 3/1991 | Mitamae | 73/12.02 X |
| 5,763,761 | 6/1998 | Parente et al. | 73/12.14 |

FOREIGN PATENT DOCUMENTS

| | | |
|---|---|---|
| 320049 | 9/1929 | United Kingdom . |

*Primary Examiner*—Elizabeth L. Dougherty
*Attorney, Agent, or Firm*—Moonray Kojima

[57] ABSTRACT

The invention relates to a golf ball test hitter used for testing the performance of a golf club after manufacture of the club, which comprises a first arm corresponding a man's arm, a second arm corresponding to a wrist, being supported at a free end of the first arm, clamping means provided in the second arm for clamping a golf club, first swivel means for swiveling and manipulating the first arm, second swivel means for swiveling and manipulating the second arm, changeover means for stopping power swivel of the second arm by the second swivel means at an arbitrary position, and changing over the second arm from power swivel to inertial swivel, and brake means for braking the second arm changed over to inertial swivel, whereby arbitrary and varied motions ranging from beginners to professional players can be obtained, and hence varied test results corresponding to various patterns (club swivel trajectories including the motion of the wrist) can be obtained.

3 Claims, 13 Drawing Sheets

GOLF BALL TEST HITTER

BACKGROUND OF THE INVENTION

1. Field of the Invention

The present invention relates to a golf ball test hitter used for testing a club after manufacture of a golf club.

2. Description of the Prior Art

The following constitution is known as a conventional golf ball test hitter.

That is, using a base member composed to be adjustable in angle, the golf ball test hitter comprises a first arm controlled in swivel by a servo motor about the central axis of this base member, and a second arm, provided at a free end of this first arm, which swivels about 1.5 times in the same direction of the swivel angle of the first arm by gear ratio or pulley ratio, in which the second arm includes clamping means for detachably fixing and holding a golf club, and twisting means for twisting the clamping means by a specified angle from a back swing top position to a follow-through end position of the golf club.

According to the conventional apparatus, a club swivel trajectory nearly equivalent to a form of a model player such as a first-class professional can be obtained by the twisting action by a specified angle, and reliable testing can be executed, but, to the contrary, since the clamping means is twisted by a single servo motor through gear coupling means (so-called uniaxial control constitution) in order to obtain the twisting angle by a specified angle, that is, a motion corresponding to the move of the wrist of the model play (so-called wrist turn), only a single monotonous specified club swivel trajectory (so-called pattern) is obtained, and various arbitrary patterns corresponding to the beginner, experienced amateur and professional cannot be obtained, and varied test results corresponding to various patterns cannot be obtained.

SUMMARY OF THE INVENTION

It is hence a primary object of the invention to present a golf ball test hitter composing a biaxial control structure with means for swiveling a first arm corresponding to a man's arm and means for swiveling a second arm corresponding to a wrist, capable of obtaining arbitrary and varied motions ranging from beginners to professional players by stopping the power swivel of the second arm at an arbitrary position by changeover means, changing over the second arm from power swivel to inertial swivel, and braking the second arm by brake means, and thereby obtaining varied test results corresponding to various patterns (club swivel trajectories including the motion of the wrist).

It is other object of the invention to present a golf ball test hitter composing a biaxial control structure with means for swiveling a first arm corresponding to a man's arm and means for swiveling a second arm corresponding to a wrist, and further comprising grip rotating means for rotating the grip about the axis through clamping means to compose a triaxial control structure in total, capable of obtaining arbitrary and varied motions ranging from beginners to professional players, and thereby obtaining varied test results corresponding to various patterns (club swivel trajectories including the motion of the wrist).

It is a further object of the invention to present a golf ball test hitter capable of executing much varied tests by comprising changeover means, brake means and grip rotating means.

Other objects of the invention will be better understood and appreciated from the following detailed description of embodiments taken in conjunction with the drawings.

DESCRIPTION OF THE PREFERRED EMBODIMENT

An embodiment of the invention is described below by referring to the accompanying drawings.

Figure 1:
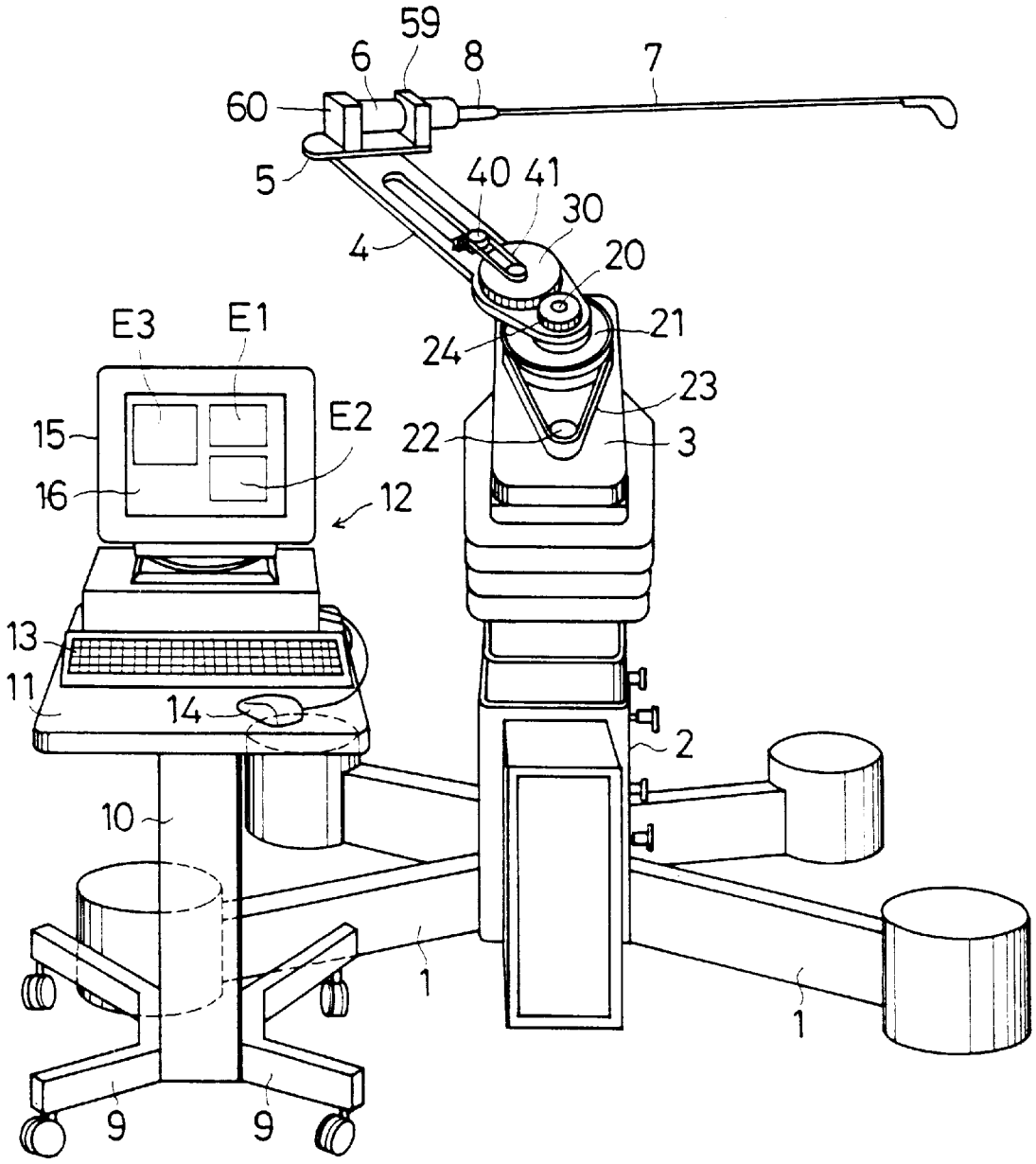
FIG. 1 is a schematic perspective view of a golf ball test hitter of the invention.
Figure 2:
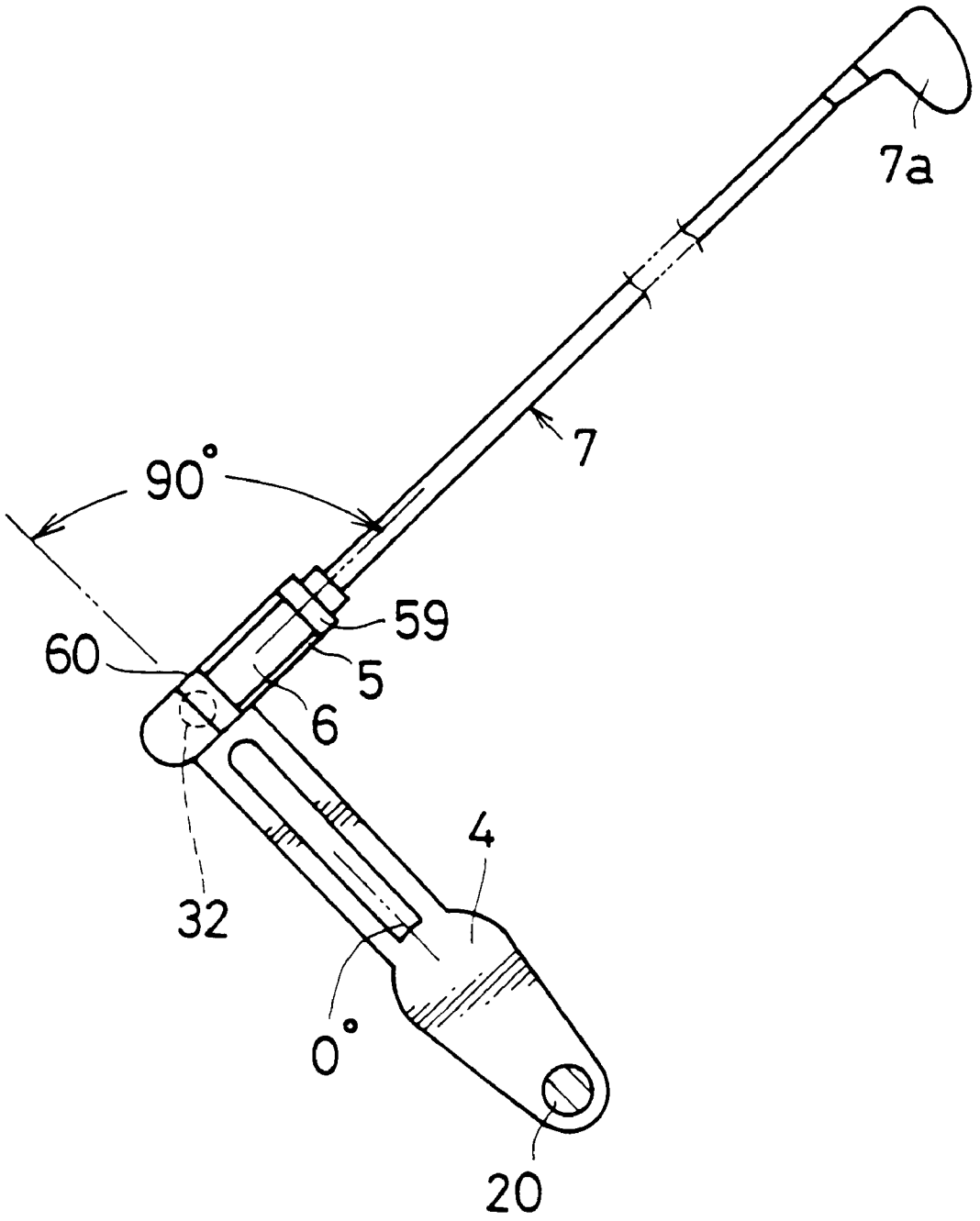
FIG. 2 is an explanatory diagram corresponding to the back swing top position.
Figure 3:
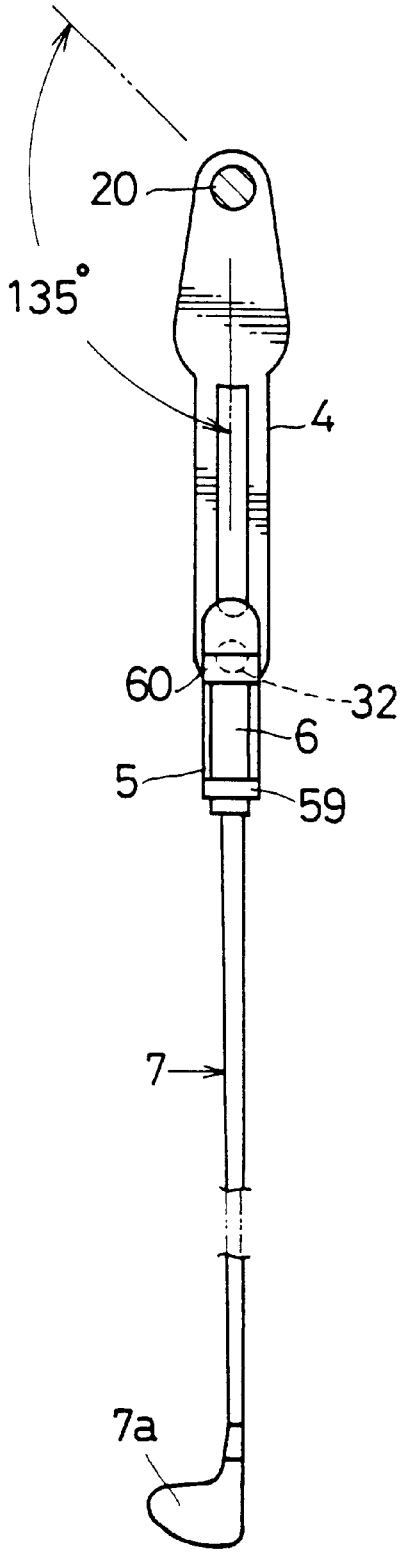
FIG. 3 is an explanatory diagram equivalent to the impact corresponding position.
Figure 4:
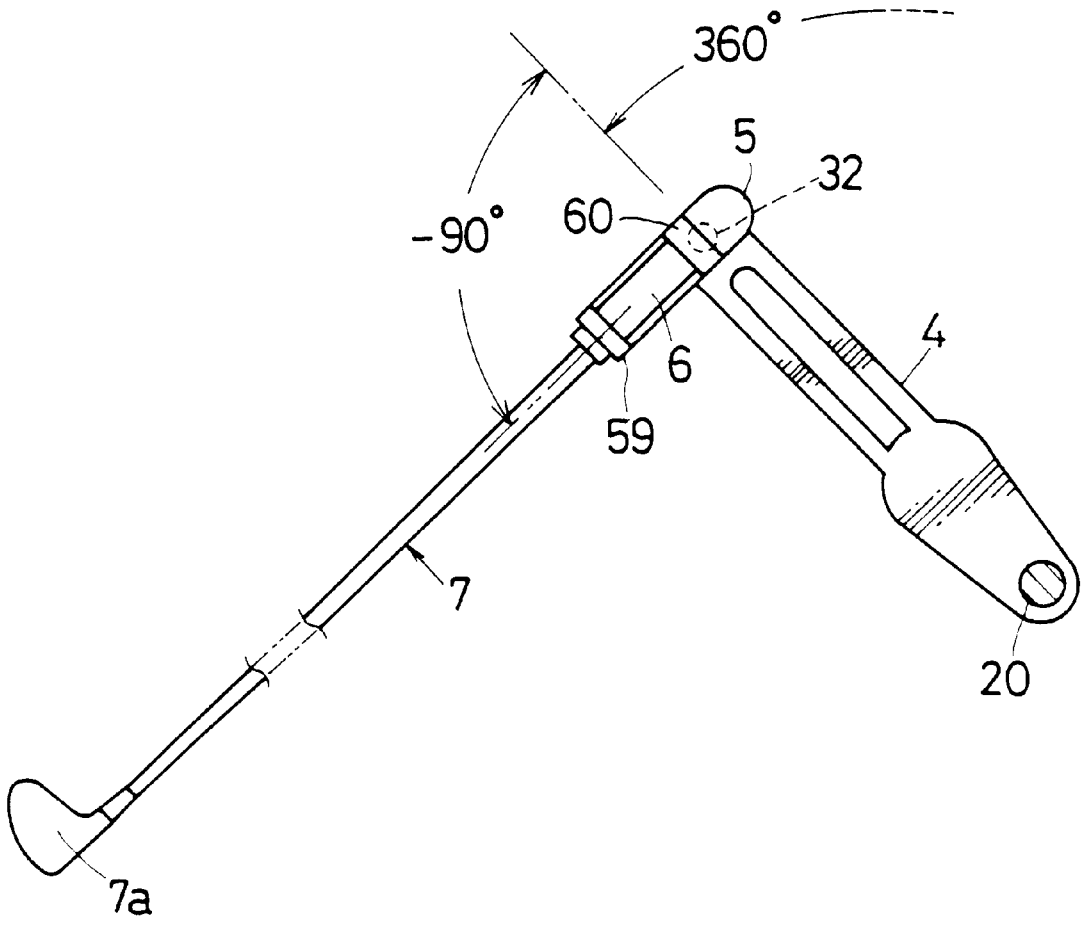
FIG. 4 is an explanatory diagram corresponding to the follow-through end position.

The drawings show a golf ball test hitter, and in FIG. 1, in a machine frame 2 set up between right and left fixed stands 1, 1, a base member 3 adjustable in vertical direction (adjustable in height) and adjustable in angle by an internal mechanism (not shown) is disposed, and on this base member 3, a first arm 4 is provided so as to be capable of swiveling independently over a range of 360 degrees from 0 degree at the back swing top position (see FIG. 2) to the follow-through end position (see FIG. 4) through the impact corresponding position (see FIG. 3), and at a free end of this first arm 4, a second arm 5 is supported so as to be capable of swiveling independently over a range of 180 degrees in total, from plus 90 degrees shown in FIG. 2 to minus 90 degrees shown in FIG. 4.

The first arm 4 corresponds to a man's arm, and the second arm 5, to a wrist, and a clamping device 6 is mounted on the top of the second arm 5, and a grip 8 of a golf club 7 is detachably fixed to this clamping device 6.

Figure 12:
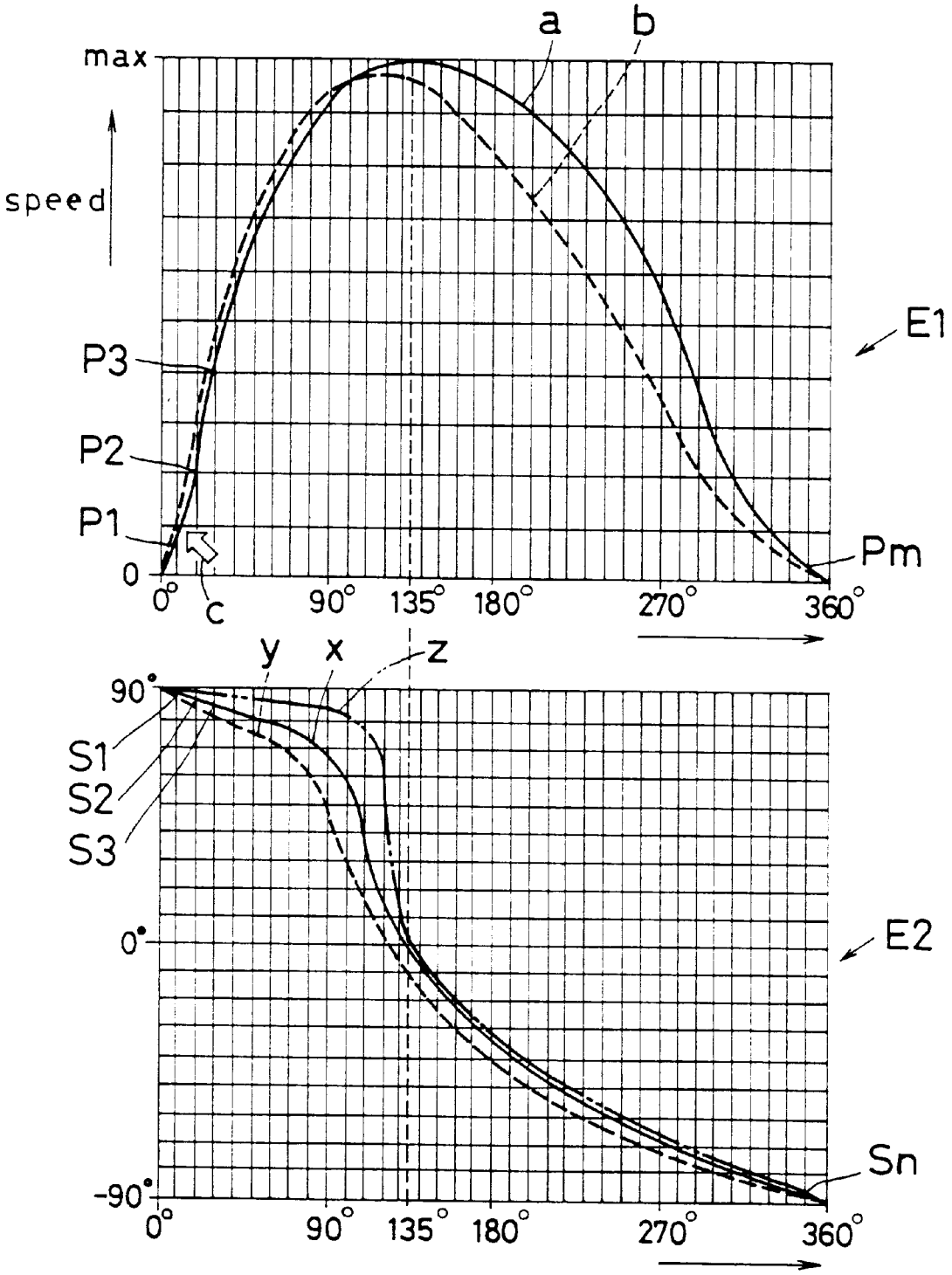
FIG. 12 is an explanatory diagram of setting image shown in a CRT display unit.
Figure 13:
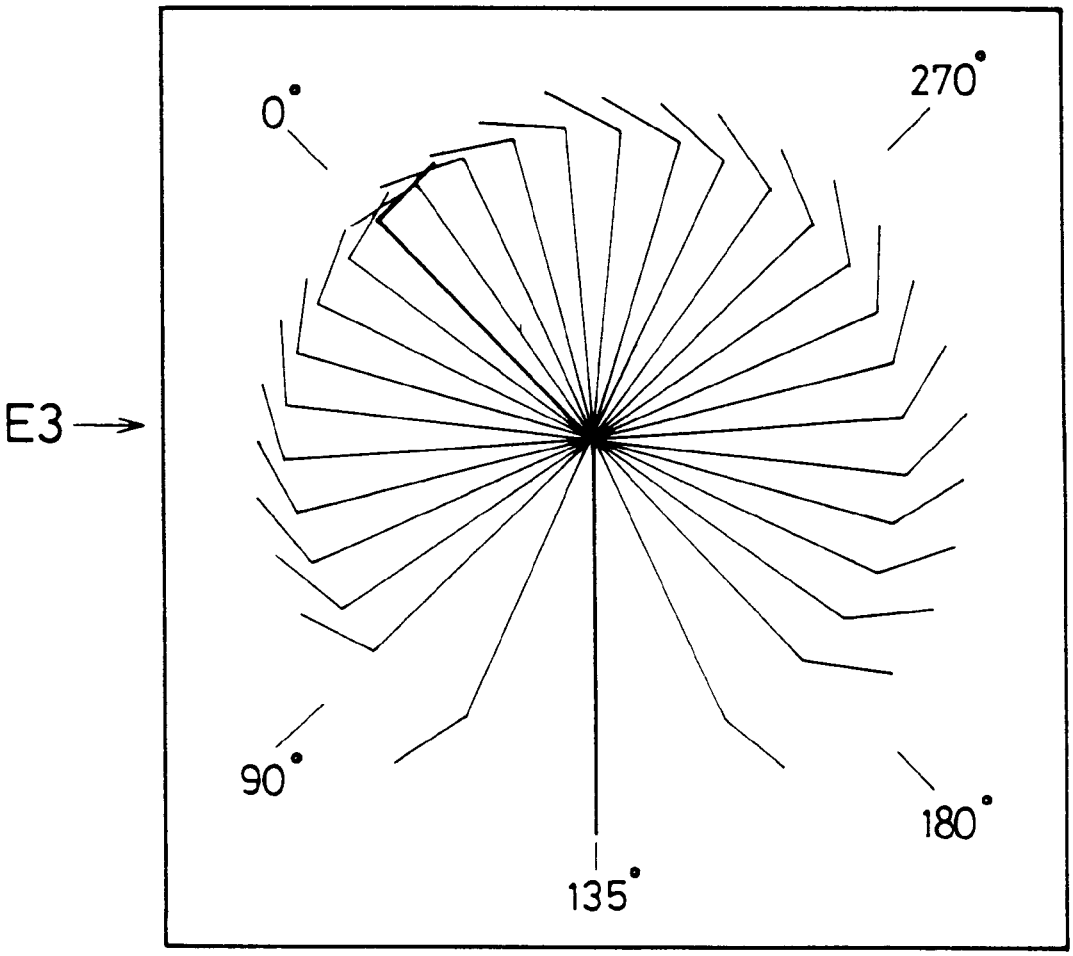
FIG. 13 is an explanatory diagram of a monitor image shown in a CRT display unit.

A table 11 is horizontally mounted on the upper end of a post 10 erected between right and left movable stands 9, 9, and a personal computer 12 is mounted on this table 11. This computer 12 comprises a keyboard 13 as input means, a mouse 14 as setting means, and a CRT display 15 as image display means, and in a first area E1 of a CRT screen 16, a first arm speed distribution image is shown as shown in FIG. 12, plotting the rotational angle of the first arm 4 on the axis of abscissas and the speed of the first arm 4 on the axis of ordinates, in a second area E2, as shown in FIG. 12, a rotational angle distribution image is shown, plotting the rotational angle of the first arm 4 on the axis of abscissas and the rotational angle of the second arm 5 and grip 8 on the axis of ordinates, and in a third area E3, as shown in FIG. 13, a comprehensive monitor image of the arms 4, 5 is shown. The above elements 9 to 16 are, meanwhile, located outside of the swivel trajectory of the golf club 7 during the test.

Figure 5:
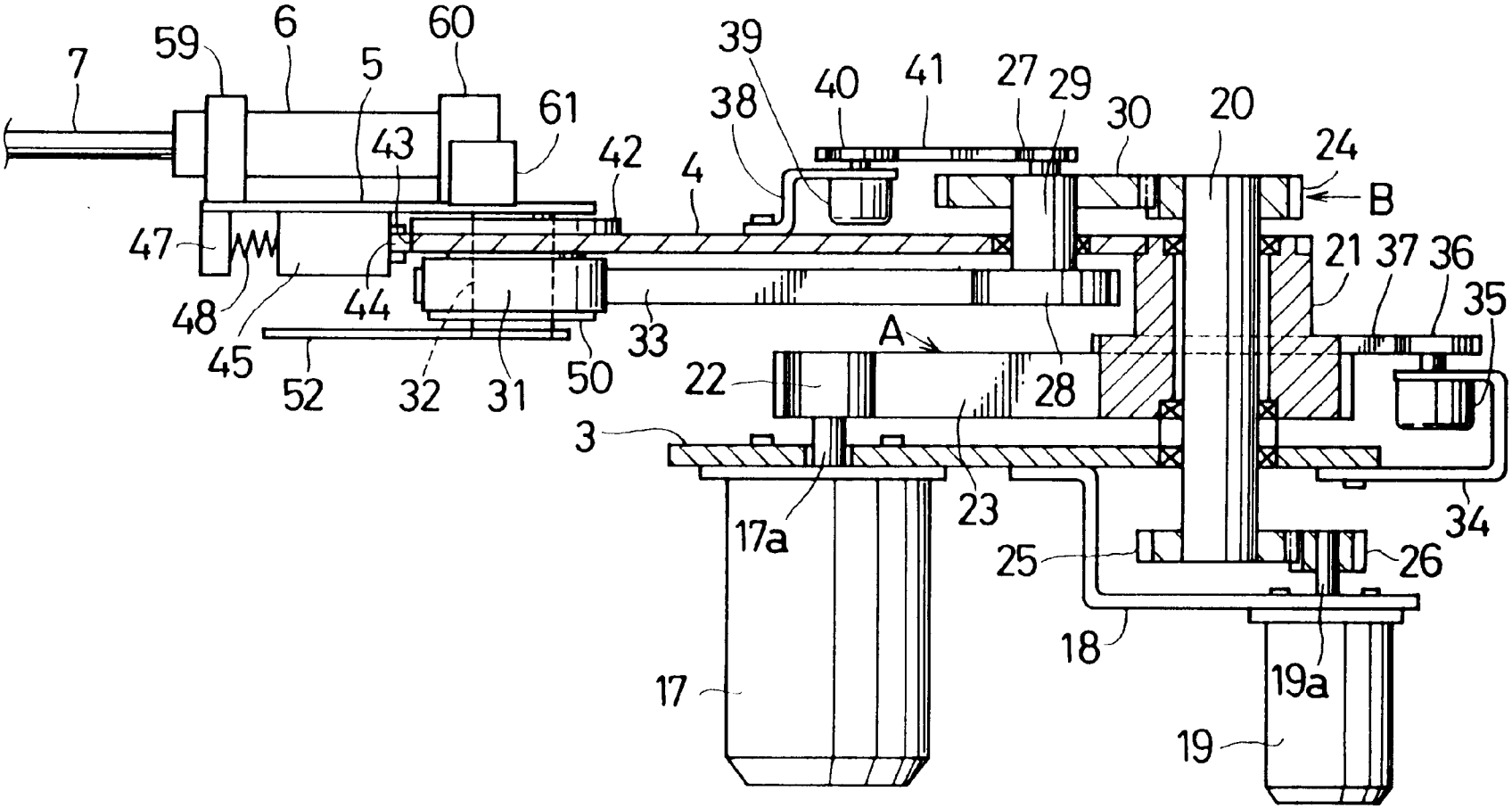
FIG. 5 is a sectional view showing an independent driving route corresponding to each arm.

Referring now to FIG. 5, the constitution of two lines of independent power transmission route for the first arm 4 and second arm 5 is described below.

At the lower surface of one end of the base member 3, a first motor 17 capable of rotating reversely and changing speed is installed, and a bracket 18 extending from the middle of the lower surface to the downward direction of the other side of the base member 3 is provided, and a second motor 19 capable of rotating reversely and changing speed is installed at the lower surface of an extending end of this bracket 18.

On the other hand, a rotary shaft 20 penetrates through the first arm 4 disposed parallel to and spaced from the base member 3, and the base member 3, and between elements 3 and 4 on this rotary shaft 20, a timing pulley 21 which rotates freely on the shaft 20 and rotates integrally with the first arm 4 is disposed.

A prime moving timing pulley 22 is fitted to a rotary shaft 17*a* of the first motor 17, and a timing belt 23 is stretched between the prime moving timing pulley 22 and the timing pulley 21, and a first power transmission route A is composed for transmitting independently the torque of the first motor 17 to the basal end of the first arm 4 through the elements 17*a*, 22, 23, 21.

Between upper and lower ends of the rotary shaft 20, gears 24, 25 are fitted respectively, and a prime moving gear 26 is fitted to a rotary shaft 19*a* of a second motor 19 attached to the bracket 18, and this prime moving gear 26 is always engaged with the gear 25 at the lower end.

At an intermediate position close to the supporting part of the rotary shaft 20 on the first arm 4, a pulley shaft 29 having timing pulleys 27, 28 at the upper and lower ends is supported, and a driven gear 30 is fitted to the upper end of this pulley shaft 29, and this driven gear 30 is always engaged with the gear 24.

Figure 6:
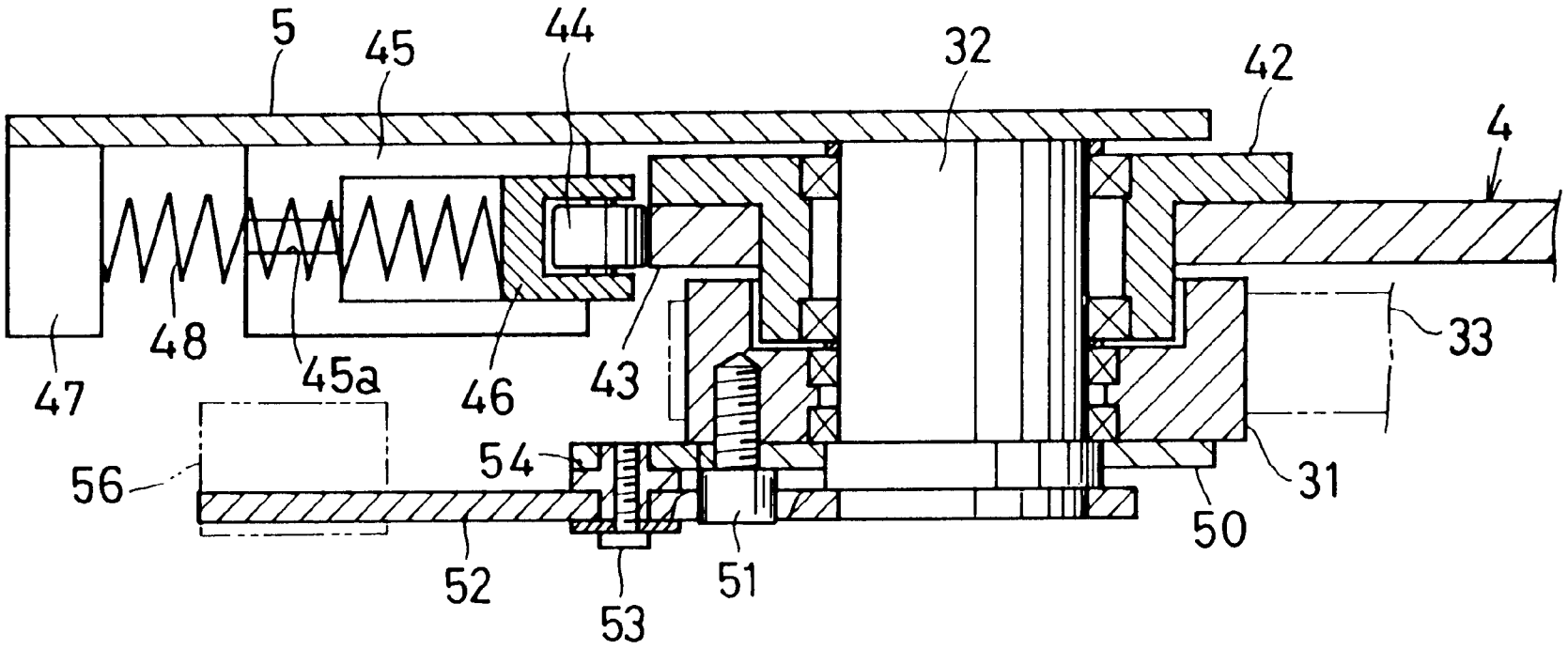
FIG. 6 is a sectional view showing a coupling structure of first arm and second arm.

On the other hand, at the free end of the first arm 4, as shown in FIG. 6, a basal end of the second arm 5 is coupled to its upper part, and a pulley shaft 32 having a timing pulley 31 is supported at the lower part. By stretching a timing belt 33 between the pulley 31 and timing pulley 28, a second power transmission route is composed for independently transmitting the torque of the second motor 19 to the basal end of the second arm 5 through the individual elements 19*a*, 26, 25, 20, 24, 30, 29, 28, 33, 31, 32.

Referring now to FIG. 5, the constitution of detecting means for detecting the position corresponding to the rotational angle of the first arm 4 and second arm 5 is described.

A pi-shaped bracket 34 extending from other end of the base member 3 to the vicinity of the timing pulley 21 is provided, and this bracket 34 is provided with a first sensor 35 as a position sensor. A pulley 36 is fitted to the shaft of this first sensor 35, and a timing belt 37 is stretched between this timing pulley 36 and the above timing pulley 21, so as to detect the position corresponding to the rotational angle of the first arm 4.

An approximately Z-shaped bracket 38 extending from the top of the intermediate part of the first arm 4 in the direction of the timing pulley 27 is provided, and this bracket 38 is provided with a second sensor 39 as position sensor. A timing pulley 40 is fitted to the shaft of the second sensor 39, and a timing belt 41 is stretched between this pulley 40 and the above timing pulley 27, thereby detecting the position corresponding to the rotational angle of the second arm 5.

Figure 7:
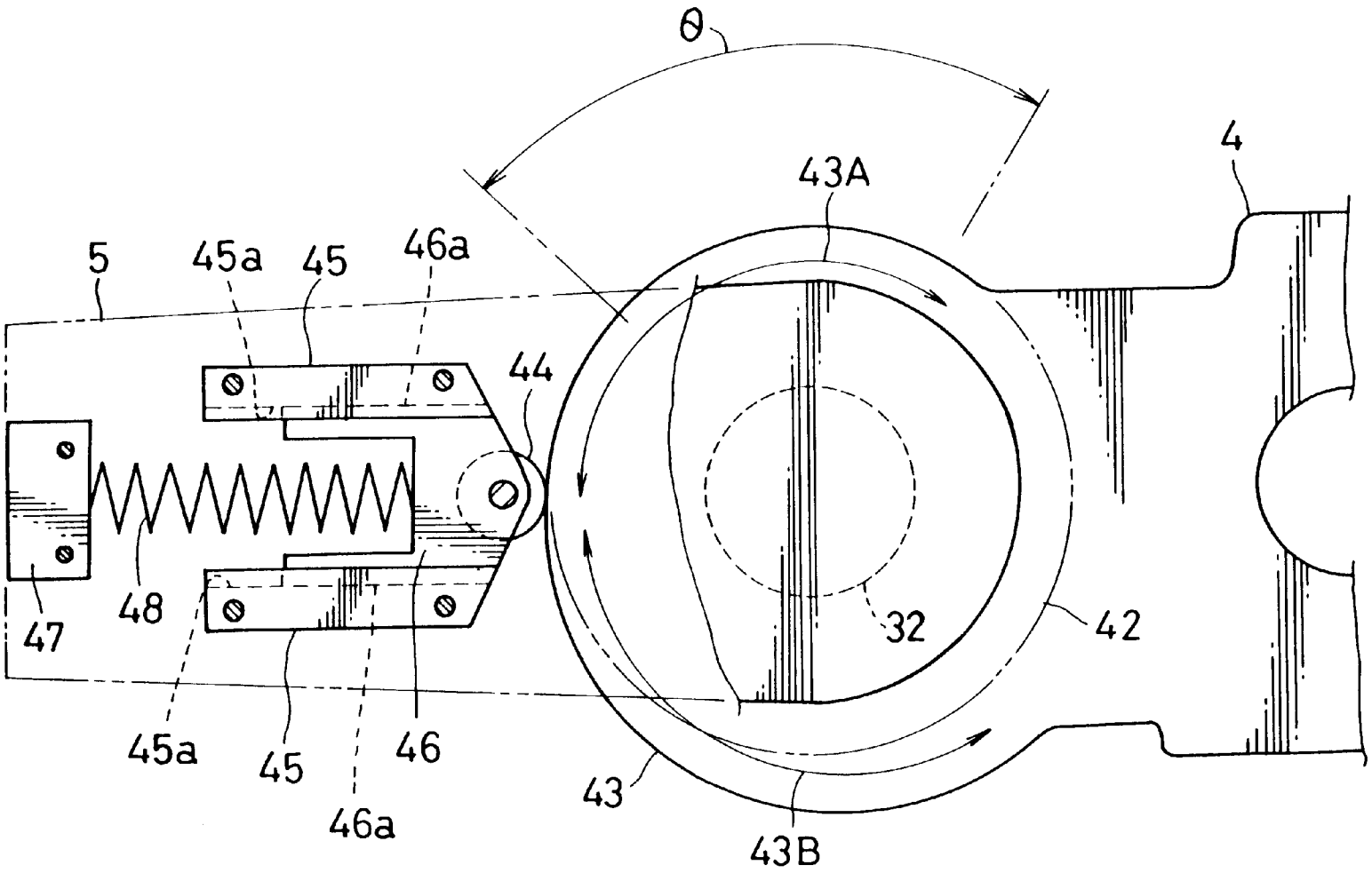
FIG. 7 is a plan view of FIG. 6.

Meanwhile, as shown in FIG. 6 and FIG. 7, a cam 43 having a round part 43A and an eccentric part 43B is integrally formed at the free end of the first arm 4 disposed on the pulley shaft 32 through a bearing 42, and a roller 44 is formed so as to roll on the peripheral surface-of this cam 43.

That is, at the lower end of the second arm 5, a pair of holders 45, 45 are provided, a slider 46 movable back and forth along the holders 45, 45 is provided, the roller 44 is supported on the slider 46, and a spring 48 is provided for thrusting in the roller pressing direction is provided between a retainer 47 fixed at the lower free end of the second arm 5 and the recess of the slider 46, so that the roller 44 may be always pressed against the circumferential surface of the cam 43.

In this embodiment, a concave groove 45*a* is formed at the holder 45 side, and a convex protrusion 46*a* is formed at the slider 46 side, thereby guiding the forward and backward motion of the slider 46, but this concave and convex structure may be reverse.

In short, the power swivel of the second arm 4 by the second motor 19 is stopped at an arbitrary position (for example, the position swiveling by angle θ from the back swing top position shown in FIG. 7) by a changeover portion 49 (see FIG. 11), and the power swivel of the second arm 5 is changed over to inertial swivel, and the roller 44 is pressed against the eccentric portion 43B, thereby composing brake means for braking the second arm 5.

The following structure is employed for power swivel, inertial swivel, and restoration of the second arm 5.

Figure 8:
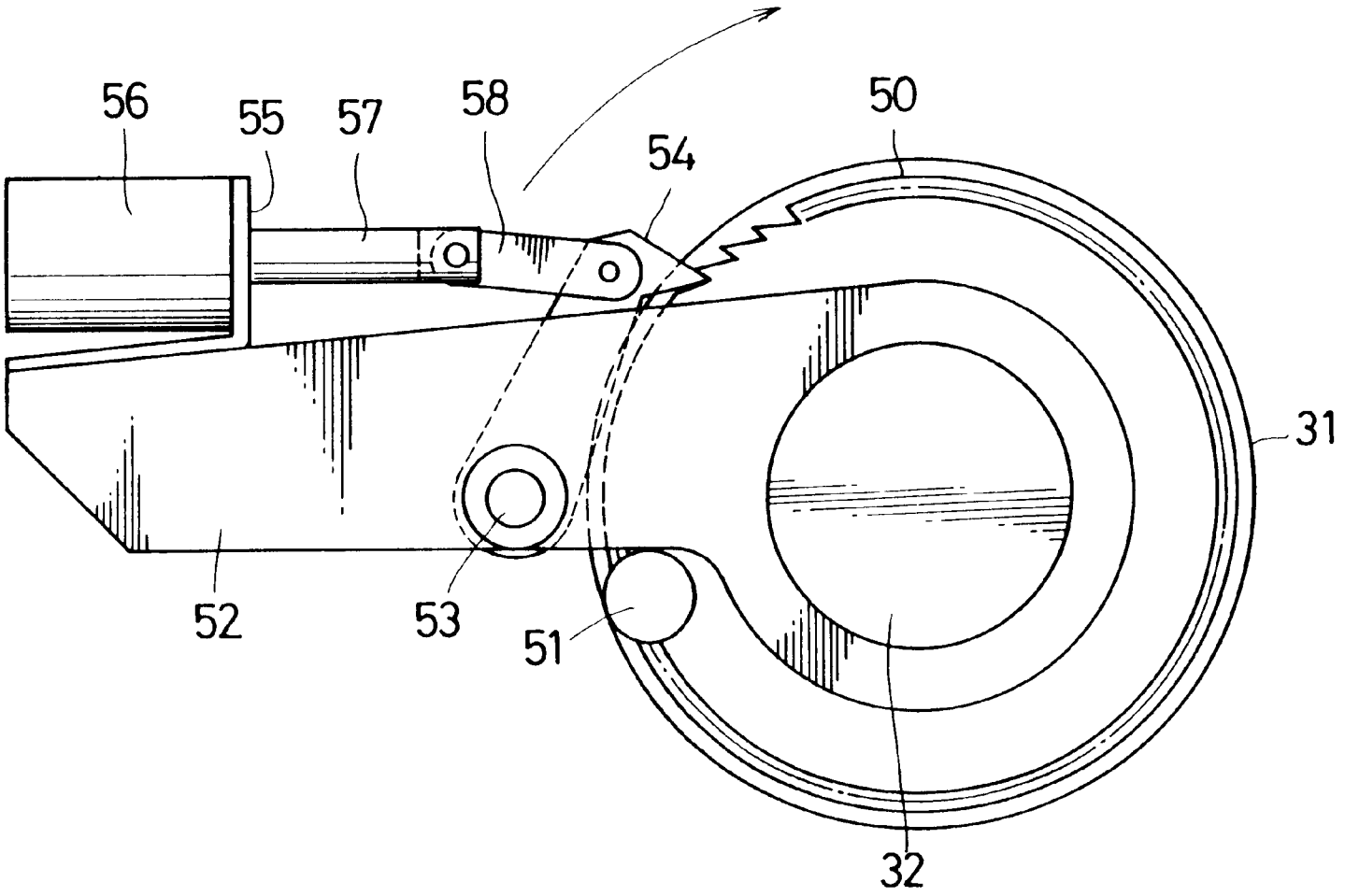
FIG. 8 is a bottom view of FIG. 6.

That is, as shown in FIG. 6 and FIG. 8, a ratchet 50 is joined to the lower surface of the timing pulley 31, a bolt 51 is planted in the pulley 31, and a plate 52 is integrally fitted to the lower end of the timing pulley 31. Moreover, around a support shaft 53 provided in the plate 52, a pawl 54 for engaging with the ratchet 50 is provided, and a solenoid 56 is provided at a free end of the plate 52 through a bracket 55, and a plunger 57 of this solenoid 56 is linked to the pawl 54 through a link 58.

At the time of swing from the back swing top position, the solenoid 56 is turned on, the pawl 54 is detached from the ratchet 50, the power of the timing pulley 31 is transmitted to the second arm 5 through the bolt 51, the plate 52 pressed by this bolt in the swing direction (arrow direction in FIG. 8), and pulley shaft 32 to permit power swivel of the second arm 5, when the second motor 19 is turned off, power swivel is changed over to inertial swivel by the changeover unit 49 (see FIG. 11), the solenoid 56 is turned off at the follow-through end position, the pawl 54 is engaged with the ratchet 50, and when returning to the state in FIG. 3 from the state in FIG. 4 through the state in FIG. 3, the plate 52 and second arm 5 are completely returned to the original positions.

Figure 9:
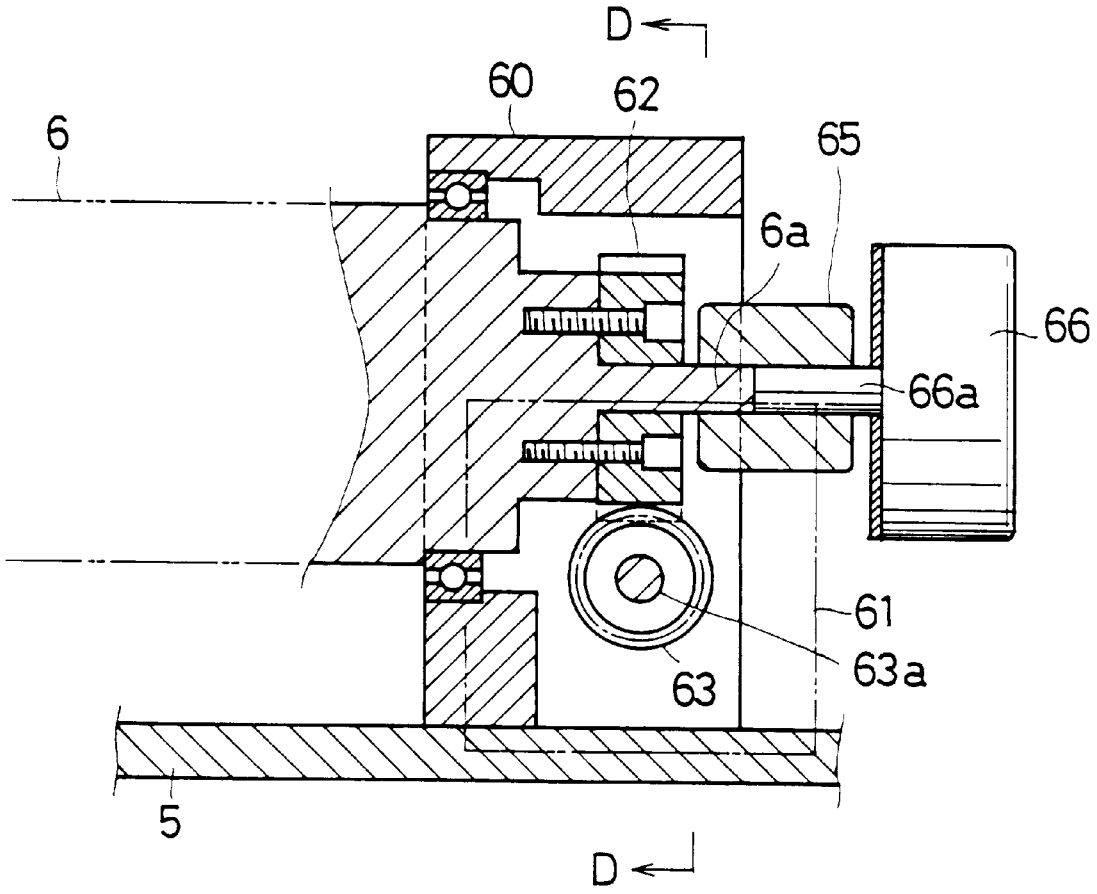
FIG. 9 is a sectional view showing a grip rotation structure.
Figure 10:
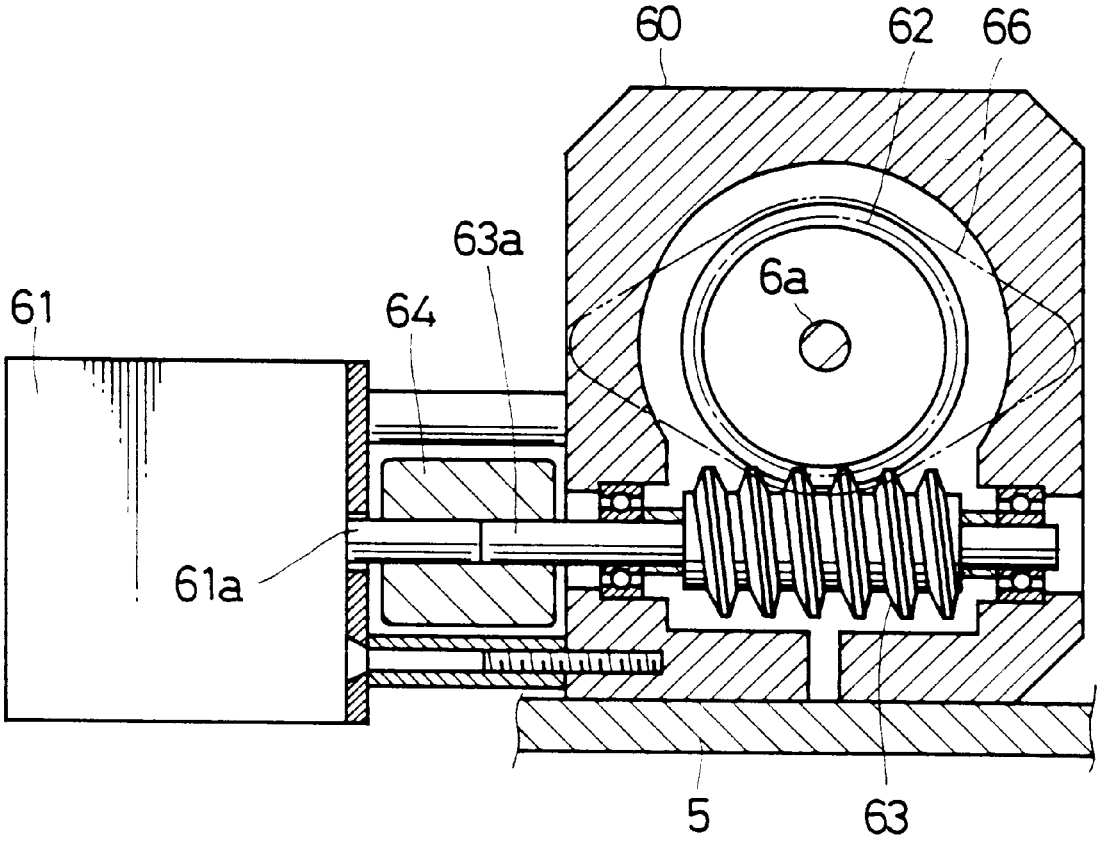
FIG. 10 is an arrow sectional view of line D—D in FIG. 9.

Referring now to FIG. 9 and FIG. 10, the mechanism for rotating the grip 8 about the shaft through the clamping device 6 is described.

The clamping device 6 is supported by two housings 59, 60, and a third motor 61 is installed at the side of one housing 60. Inside of the housing 60, a worm wheel 62 is bolted up at the basal end side of the clamping device 6, and a worm 63 to be always engaged with the worm wheel 62 is supported at the lower part of the housing 60.

A shaft 63*a* of the worm 63 and a rotary shaft 61*a* of the third motor 61 are coupled through a joint 64 so as to rotate the clamping device 6 by the third motor 61, while a projecting shaft 6*a* of the clamping device 6 is coupled with a shaft 66*a* of a third sensor 66 through a joint 65, thereby detecting the rotation of the clamping device 6 by this third sensor 66.

Herein, the motors 17, 19, 61 may be AC servo motors capable of rotating the rotors in a specified direction at a rotating speed proportional to the control current, and the sensors 35, 39, 66 may be rotational angle detecting means such as potentiometers and rotary encoders.

Figure 11:
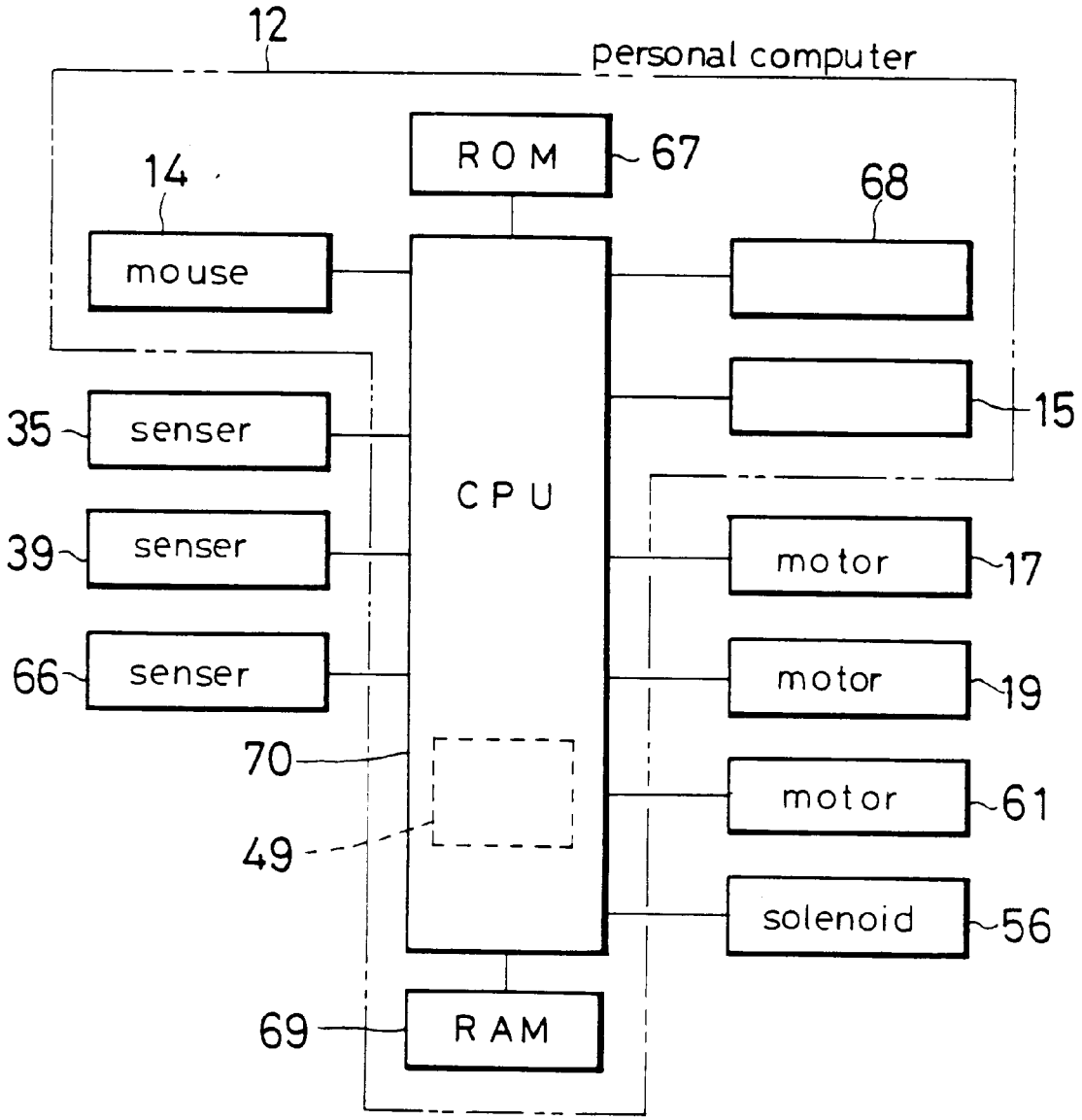
FIG. 11 is a block diagram of a control circuit.

FIG. 11 is a block diagram of a control circuit of the golf ball test hitter, in which a CPU 70 drives and controls a cursor moving unit 68, CRT display 15, first motor 17, second motor 19, third motor 61, and solenoid 56, according to the program stored in a ROM 67, on the basis of a necessary signal input from the mouse 14, first sensor 35, second sensor 39, and third sensor 66, and a RAM 69 is memory means for storing speed distribution data of the first arm 4 and rotational angle distribution data or grip rotational angle distribution data of the second arm 5, being arbitrarily and variously set by the mouse 14 as the setting means.

Herein, the CPU 70 also serves as control means for driving and controlling the motors 17, 19, 61 and solenoid 56 according to the memory content in the RAM 69.

First, the power source of the personal computer 12 is turned on to drive the CRT display 15, and section paper line images (images without drawing of curves in FIG. 12) are displayed in the first area E1 and second area E2.

The axis of abscissas of the section paper line image in the first area E1 denotes the rotational angle from 0 degree (see FIG. 2) to 360 degrees (see FIG. 4) of the first arm 4, and the axis of ordinates represents the speed from zero to maximum of the first arm (the driving speed of the first motor 17), the axis of abscissas of the section paper line image in the second area E2 denotes the rotational angle from 0 degree to 360 degrees of the first arm 4, and the axis of ordinates represents the rotational angle of the second arm 5 from plus 90 degrees (see FIG. 2) to minus 90 degrees (see FIG. 4) (the driving speed of the second motor 19), and the rotational angle of the grip (the driving speed of the third motor 61). In this embodiment, the impact corresponding position (see FIG. 3) is set at 135 degrees, and the range of the axis of abscissas from 0 degree to 360 degrees is equally divided into multiple sections.

Next, while observing the CRT screen 16, the mouse 14 is moved and manipulated on the table 11, the position of the mouse cursor c on the section paper line image in the first area E1 is designated by rotation of the mouse ball through the cursor moving unit 68, and by setting the input of points P1, P2, P3, . . . , Pm shown in FIG. 12 by the mouse key switch (not shown), the speed distribution of the first arm 1 is drawn as indicated by curve a in the diagram. All the speed distribution information is stored in the RAM 69.

Then, further moving and manipulating the mouse 14 on the table 11 while observing the CRT screen 16, the position of the mouse cursor on the section paper line image in the second area E2 is designated by rotation of the mouse ball through the cursor moving unit 68, and by setting the input of points S1, S2, S3, . . . , Sn shown in FIG. 12 by the mouse key switch, the rotational angle distribution of the second arm as indicated by curve x and the rotational angle distribution of the grip 8 as indicated by curve z are drawn in the same diagram. The information of these rotational angle distributions is also completely stored in the RAM 69 same as the information of the speed distribution.

Herein, the curves a, x, and z correspond to the best forms of a professional model player, and in the first area E1, the speed of the first arm 4 is the maximum at line of 135 degrees equivalent to the impact corresponding position, in the second area E2, the curve x has a steep gradient from slightly before the impact corresponding position to the impact corresponding position, the swivel angle of the second arm 5 is as shown in FIG. 3 at line of 135 degrees and a wrist motion corresponding to the wrist turn is obtained, but the input setting curve is not limited to the curves a, x, z indicated by solid line in FIG. 12, but, aside from curves b and y, various curves can be drawn arbitrarily by the manipulation of the mouse 14 depending on the motions of the beginners and professionals, and all of them can be stored in the RAM 69. Moreover, setting of changeover point (see angle θ) from power swivel to inertial swivel of the second arm 5 shown in FIG. 7 can be also entered arbitrarily.

Consequently, a comprehensive monitor image of the curve a drawn in the first area E1 and the curves x, z drawn in the second area E2 is displayed in the third area E3 (see FIG. 13), and the set data can be confirmed.

In this way, when input of setting of the speed distribution (see curve a) of the first arm 4, rotational angle distribution (see curve x) of the second arm 5, and rotational angle distribution (see curve z) of the grip 8 is over, test hitting by the golf ball test hitter is executed, and driving of the motors 17, 19, 61 by CPU 70 is controlled according to the memory of the above distribution information preliminarily stored in the RAM Accordingly, from the back swing top position shown in FIG. 2 to the follow-through end position shown in FIG. 4 through the impact corresponding position shown in FIG. 3, the first arm 4, second arm 5, and golf club 7 can be swiveled and rotated by the motors 17, 19, 61, and at the position of specified angle θ shown in FIG. 7, power swivel can be changed over to inertial swivel, and the golf ball (not shown) is hit by the club head 7*a* at the end of the golf club 7, and golf ball flying distance test, delicate angles of club face, and other minute and multiple test data can be obtained.

In short, the first arm 4 is swiveled and manipulated by the first swivel means (see the first motor 17), and the second arm 5 is swiveled and manipulated by the second swivel means (see the second motor 19), so that biaxial control structure is composed. Moreover, the changeover unit 49 stops the power swivel of the second arm 5 by the second swivel means (see the second motor 19) at an arbitrary position, and the second arm 5 is changed over from power swivel to inertial swivel, while the brake means (see the eccentric part 43B, roller 44) brakes the second arm 5 changed over to inertial swivel.

Accordingly, by selection of moving speed of the arms 4, 5 by the swivel means (see the motors 17, 19) and on/off switching of the changeover unit 49, arbitrary and varied motions ranging from beginners to professional players can be obtained, and varied test results corresponding to various patterns can be obtained.

Still more, since the grip rotation means (see the third motor 61) can rotate the grip 8 about the shaft through the clamp means (see the clamping device 6), a triaxial control structure is composed in total, so that arbitrary and varied motions ranging from beginners to professional players can be obtained, and various flying distance test and club performance test corresponding to various patterns can be experimented.

As shown in the embodiment, moreover, when the images sequentially set and entered by the mouse 14 are displayed in the display means such as CRT display 15, it is possible to enter and set while observing the image on the CRT screen 16, and the input operation is facilitated, and the visual recognition is enhanced.

Further, by employing the brake means by both cam 43 and roller 44, an adequate brake force corresponding to the cam profile can be obtained, and the control is facilitated as compared with the mechanism using electromagnetic brake.

In the correspondence between the constitution of the invention and the embodiment, the clamping means of the invention corresponds to the clamping device 6 in the embodiment, and similarly, the first swivel means, to the first motor 17, the second swivel means, to the second motor 19, the changeover means, to the changeover unit 19, the brake means, to the cam 43 and roller 44, and the grip rotation means, to the third motor 61, respectively.

The invention is not limited to the constitution of the embodiment alone.

In the embodiment, it is designed to set and enter by using the mouse 14, but the setting means may be also composed of both pen input means and CRT touch panel means, or if the memory capacity is insufficient in the RAM 69, the memory means may be composed by connecting a table, map, floppy disk, or the like capable of updating data, to the CPU 70.

In the embodiment, the input is set supposing the back swing top position to be 0 degree, the impact corresponding position to be 135 degrees, and the follow-through end position to be 360 degrees, but the input setting condition of the axis of abscissas may be set at different angles, for example, the impact corresponding position at 0 degree, the back swing top position at minus 135 degrees, and the follow-through end position at 225 degrees. Similarly, in the second area E2, the initial setting angle of the second arm 5 is plus 90 (see the axis of ordinates), but this initial setting angle may be set at 0 degree, and the rotating operation and input setting of the second arm 5 may be in a range of 0 degree to 180 degrees.

The numerical values of angles shown in the embodiment are only examples, and hence are not limitative.

Instead of the mechanical brake means by the cam 43 and roller 44, an electromagnetic brake for braking the rotary shaft 19*a* of the second motor 19 may be used, and instead of the on/off means of the power transmission to the second arm 5 through the ratchet 50, pawl 54, and solenoid 56, an electromagnetic clutch for controlling transmission and non-transmission of the power of the timing pulley may be employed.

Or, instead of the roller 44, a follower member merely being thrust by spring to the circumferential surface of the cam 43 may be used.

What is claimed is:

1. A golf club striking apparatus comprising:

a first rotatable arm corresponding to a person's arm;

a second rotatable arm corresponding to a person's wrist, said second rotatable arm being rotatably supported at a free end of said first rotatable arm;

clamping means provided in said second arm for clamping a shaft of a golf club;

first swivel means comprising a first electric motor for independently swiveling and manipulating said first rotatable arm;

second swivel means comprising a second electric motor for independently swiveling and manipulating said second rotatable arm;

changeover means for selectively controlling said first electric motor and said second electric motor to thereby stop a power swivel state of said second rotatable arm by said second swivel means at an arbitrary position, and for changing over said second rotatable arm from said power swivel state to an inertial swivel state;

brake means for braking said second rotatable arm when said second rotatable arm is changed over to said inertial swivel state; and grip rotating means comprising a third electric motor for independently rotating a grip about said shaft of said golf club through said clamping means.

2. A golf ball striking apparatus comprising:

a first movable arm corresponding to a person's arm;

a second movable arm corresponding to said person's wrist, said second movable arm being supported at a free end of said first movable arm;

clamping means provided in said second movable arm for clamping a shaft of a golf club;

first swivel means comprising a first electric motor for independently swiveling and manipulating said first rotatable arm;

second swivel means comprising a second electric motor for independently swiveling and manipulating said second movable arm; and grip rotating means comprising a third electric motor for independently rotating a grip about said shaft of said golf club through said clamping means.

3. The apparatus of claim 2, further comprising means for selectively controlling said first electric motor, said second electric motor and said third electric motor to selectively rotate said first rotatable arm, said second rotatable arm and said clamping means and thereby cause the golf club to imitate a person's swing in a controllable manner.

* * * * *